United States Patent [19]

Hackbarth et al.

[11] 3,975,122

[45] Aug. 17, 1976

[54] ROTARY INTERNAL COMBUSTION ENGINE

[75] Inventors: Eugene R. Hackbarth, Kenosha, Wis.; Harry M. Ward, III, Waukegan, Ill.

[73] Assignee: Outboard Marine Corporation, Waukegan, Ill.

[22] Filed: Feb. 20, 1974

[21] Appl. No.: 444,044

[52] U.S. Cl. ..... 418/83; 418/149

[51] Int. Cl.[2] ..... F01C 21/06; F01C 19/12

[58] Field of Search ..... 418/83, 149, 61 A; 123/8.01

[56] References Cited

UNITED STATES PATENTS

| | | | |
|---|---|---|---|
| 3,091,386 | 5/1963 | Paschke | 418/61 A |
| 3,280,802 | 10/1966 | Froede | 123/8.01 |
| 3,292,601 | 12/1966 | Bensinger et al. | 418/83 |
| 3,298,330 | 1/1967 | Ito et al. | 123/8.01 |
| 3,313,276 | 4/1967 | Ito et al. | 418/83 |
| 3,644,070 | 2/1972 | Lermusiaux | 418/61 A |
| 3,695,790 | 10/1972 | Jones | 418/149 |

FOREIGN PATENTS OR APPLICATIONS

| | | | |
|---|---|---|---|
| 693,906 | 9/1964 | Canada | 123/8.01 |
| 1,451,693 | 3/1970 | Germany | 123/8.01 |
| 1,167,589 | 4/1964 | Germany | 418/149 |

*Primary Examiner*—Carlton R. Croyle
*Assistant Examiner*—Leonard Smith
*Attorney, Agent, or Firm*—Michael, Best & Friedrich

[57] ABSTRACT

Disclosed herein is a rotary internal combustion engine comprising a unitary housing member including first annularly extending wall means including an outwardly facing surface partially defining a cooling jacket extending generally circumferentially around the first wall means, and an inwardly facing surface partially defining a rotor cavity, together with second wall means extending in outwardly spaced relation from the first wall means and including an inwardly facing surface in opposing relation to the outwardly facing surface of the first wall means to further partially define the cooling jacket, and web means extending generally transversely to and joining the first and second wall means.

Also disclosed herein is a rotary internal combustion engine comprising a housing assembly including a housing member having an end wall and wall means partially defining a rotor cavity extending to the end wall and having a portion in which combustion takes place and also partially defining a cooling jacket extending adjacent to the cavity portion and to the end wall, together with a cover on the housing member end wall and including a first portion further defining the rotor cavity and a second portion further defining the cooling jacket.

In addition, the cover also includes wall means spaced from said rotor cavity for partially defining a second cooling jacket extending along the cover adjacent to the cavity portion, and the housing assembly also includes a coolant inlet communicating with each of the cooling jackets, and a coolant outlet communicating with each of the cooling jackets whereby one portion of the coolant flows between the inlet and the outlet through one of the cooling jackets and another portion of the coolant flows between the inlet and the outlet through the other of the cooling jackets.

In further addition, the cover also includes an endless recess extending circumferentially around the second cover portion further defining the cooling jacket, together with means extending between the housing member and the cover outside of the area bounded by the endless recess for connecting the cover to the end wall, and a sealing member located in the endless recess and in sealing engagement with the cover and with the end wall to prevent loss of coolant from the cooling jacket between the cover and the housing member.

10 Claims, 6 Drawing Figures

ROTARY INTERNAL COMBUSTION ENGINE

BACKGROUND OF THE INVENTION

The invention relates generally to rotary internal combustion engine and, more particularly, to the housing member which, in part, defines the rotor cavity. In addition, the invention relates to cooling jacket arrangements for rotary internal combustion engines and to arrangements for sealing such cooling jackets and for assembling various of the components of a rotary internal combustion engine.

SUMMARY OF THE INVENTION

The invention provides a rotary internal combustion engine comprising a unitary housing member including first annularly extending wall means including an outwardly facing surface partially defining a cooling jacket extending generally circumferentially around the first wall means, and an inwardly facing surface partially defining a rotor cavity, together with second wall means extending in outwardly spaced relation from the first wall means and including an inwardly facing surface in opposing relation to the outwardly facing surface of the first wall means to further partially define the cooling jacket, and web means extending generally transversely to and joining the first and second wall means.

The invention further provides a rotary internal combustion engine comprising a housing assembly including a housing member having an end wall and wall means partially defining a rotor cavity extending to the end wall and having a portion in which combustion takes place and also partially defining a cooling jacket extending circumferentially of the housing member adjacent to the cavity portion and to the end wall, together with a cover on the housing member end wall and including a first portion further defining the rotor cavity and a second portion further defining the cooling jacket.

In still further accordance with the invention, the just mentioned cover also includes other wall means spaced from the rotor cavity for partially defining a second cooling jacket extending along the cover adjacent to the cavity portion, together with coolant inlet means communicating with each of the cooling jackets, and coolant outlet means communicating with each of the cooling jackets whereby one portion of the coolant flows between the inlet means and the outlet means through one of the cooling jackets and another portion of the coolant flows between the inlet means and the outlet means through the other of the cooling jackets.

Also in accordance with the invention, the cover also includes an endless recess extending circumferentially around the second cover portion further defining the cooling jacket, together with means extending between the housing member and the cover outside of the area bounded by the endless recess for connecting the cover to the end wall, and a sealing member located in the endless recess and in sealing engagement with the cover and with the end wall to prevent loss of coolant from the cooling jacket between the cover and the housing member.

One of the principal features of the invention is the provision of a rotary internal combustion engine having a unitary housing member providing a cooling jacket extending at least partially circumferentially of the rotor cavity and in which flow takes place circumferentially of the rotor cavity.

Another of the principal features of the invention is the provision of a rotary internal combustion engine having a unitary housing member which generally has an H-shape along a section extending from the rotor cavity to the outside of the housing member.

Still another of the principal features of the invention is the provision of an end plate or cover which is connected to a housing member to complete a rotor cavity and to complete a circumferentially extending cooling jacket.

Still another of the principal features of the invention is the provision, in a cover of a housing assembly of a rotary internal combustion engine, of an endless recess which surrounds that portion of the cover which defines a circumferentially extending cooling jacket, together with a sealing member located in the endless recess, and bolts or other connecting means extending between the cover and the housing member in areas outside of the endless recess.

Still another of the principal features of the invention is the provision of an additional cooling jacket on a cover of a housing assembly of a rotary internal combustion engine, which additional cooling jacket communicates with an inlet common to a circumferentially extending jacket and with an outlet common to the circumferentially extending jacket so that the coolant flow includes one portion flowing through the circumferentially extending jacket and another portion flowing through the cover cooling jacket in parallel relation to the flow through the circumferentially extending jacket.

Other objects and advantages of the invention will become known by reference to the following drawings, general description, and claims.

THE DRAWINGS

Before explaining the invention in detail, it is to be understood that the invention is not limited in its application to the details of the construction and arrangement of parts set forth in the following general description or illustrated in the accompanying drawings, since the invention is capable of other embodiments and of being practiced or carried out in various ways. Also, it is to be understood that the phraseology or terminology employed herein is for the purpose of description and not of limitation.

GENERAL DESCRIPTION

Figure 3:
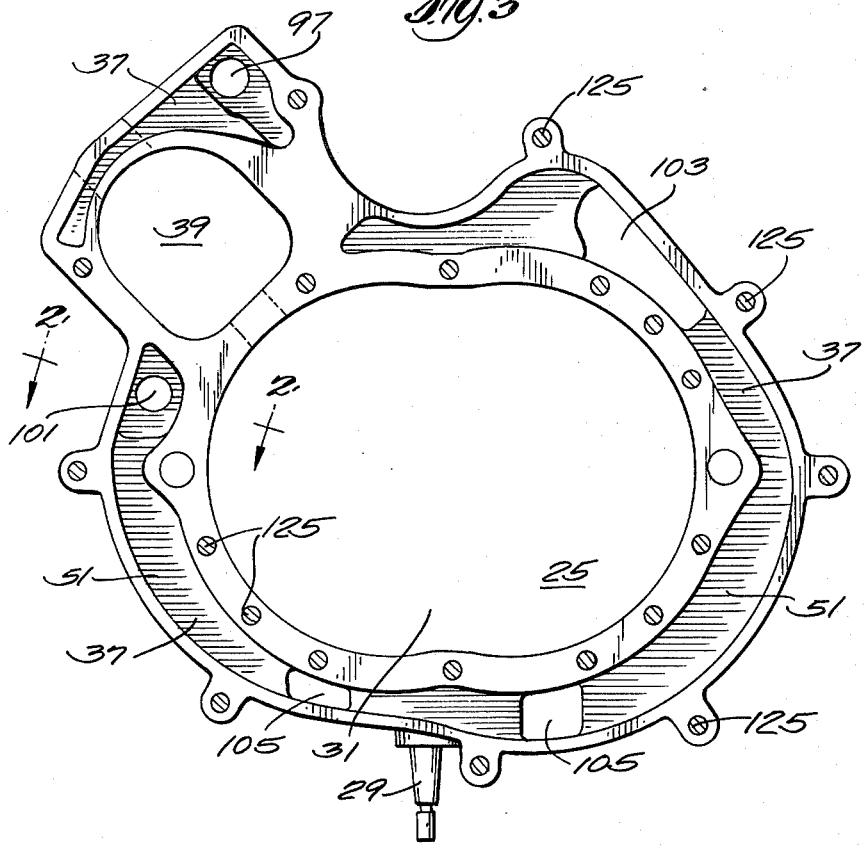
FIG. 3 is taken along the line 3—3 of FIG. 1 and is an end view of the housing member incorporated in the rotary internal combustion engine shown in FIG. 1.

Shown in the drawings is a rotary internal combustion engine 11 which comprises a housing assembly 13 including an integral housing member 15 having opposed and generally parallel end walls or faces 17 and 19. Also included in the housing member 15 are first wall means 21 having a first or inwardly surface 23 which extends from one end wall 17 to the other end wall 19 and which partially defines a rotor cavity 25 receiving a generally triangular shaped rotor 27 which is rotatable about an axis offset with respect to he rotor center. Supported by the housing member 15 for operation in the rotor cavity 25 is (See FIG. 3) a spark plug 29 which causes combustion in a portion 31 of the rotor cavity 25 which extends from around the spark plug 29 in the direction of rotor rotation and which is relatively hotter than the remainder of the rotor cavity. The constructional details of the rotor cavity 25 and of the rotor 27 are not a part of the invention except for extension of the rotor cavity 25 to the end walls 17 and 19 of the housing member 15.

The previously mentioned first wall means 21 also includes (See FIG. 1) a second or outwardly facing surface 33 which partially defines a cooling jacket 37 extending along the housing member 15 partially circumferentially of, and adjacent to the rotor cavity 25 and at least along the housing member 15 in the area of the portion 31 of the rotor cavity 25 in which combustion takes place. The cooling jacket 37 can also extend (See FIG. 3) around an exhaust passage 39 leading from the rotor cavity 25.

The housing member 15 includes (See FIG. 1) second wall means 41 which is located outwardly of the first wall means 21 relative to the rotor cavity 25, which generally extends from one end wall 17 to the other end wall 19, and which includes an inwardly facing surface 43 cooperating with the outwardly facing surface 33 to partially define the cooling jacket 37. The second wall means 41 of the housing member 15 also includes an outwardly facing surface 47 which can constitute a part of the exterior or outer surface of the housing assembly 13.

Also integrally included in the housing member 15 is wall means in the form of a web 51 which connects the first and second wall means 21 and 41, respectively, and which extends generally transversely to the direction of the rotor axis. The web 51 is preferably apertured in several places as hereinafter disclosed to permit coolant flow from one side to the other of the web 51.

In the preferred and illustrated construction, the housing member 15 is a unitary die cast member, with the web 51 located intermediate the end walls 17 and 19 and with a parting line 53 located centrally of the web 51. The web 51 and the first and second wall means 21 and 41, respectively, thereby form a generally H-shaped cross section with one side of one leg constituting the inwardly facing surface 23 of the rotor cavity 25 and with the space between the legs to both sides of the cross bar or web 51 providing the cooling jacket 37. Accordingly, both the rotor cavity 25 and the cooling jacket 37 are provided in a unitary die cast member. Of course, if desired, other processes could be employed for fabricating the housing member 15.

It is particularly to be noted that the first and second wall means 21 and 41, respectively, of the housing member 15 can be made relatively thin without sacrificing rigidity or strength due to the H-shaped formation.

The housing assembly 13 also includes opposed end plates or covers 61 and 63 which are respectively located along the opposed end walls 17 and 19. Except as hereinafter mentioned, the covers 61 and 63 are generally of similar construction, and thus only the cover 61 will be further described in detail.

Figure 4:
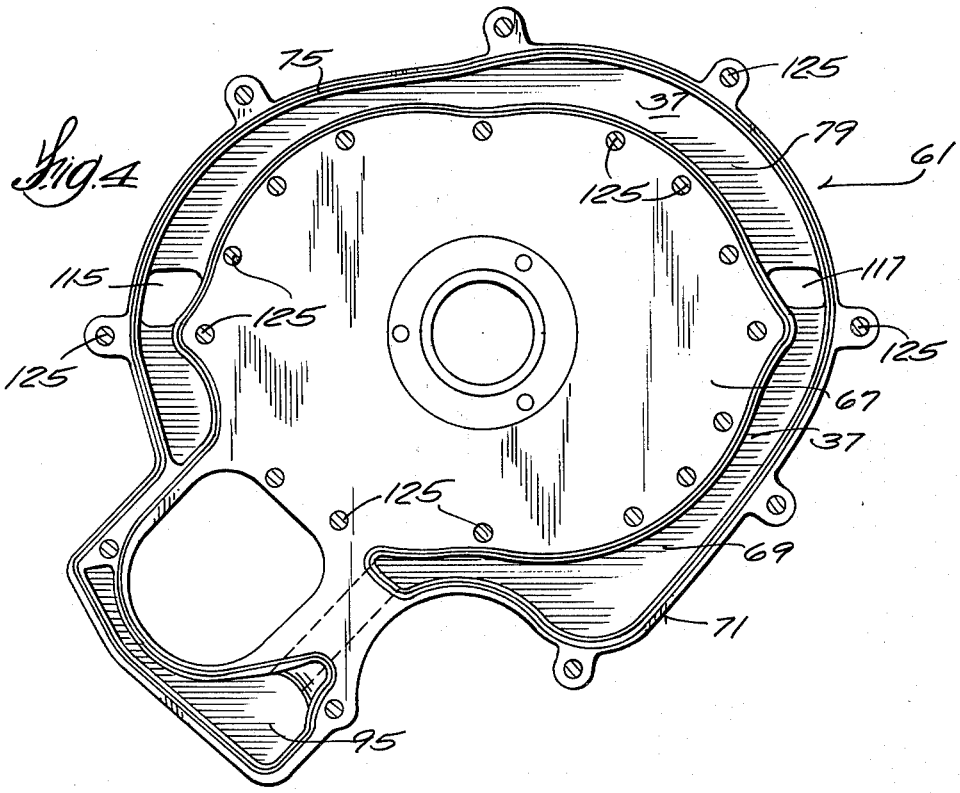
FIG. 4 is taken along the line 4—4 of FIG. 1 and is a view of the inside of one of the covers incorporated in the rotary internal combustion engine shown in FIG. 1.
Figure 5:
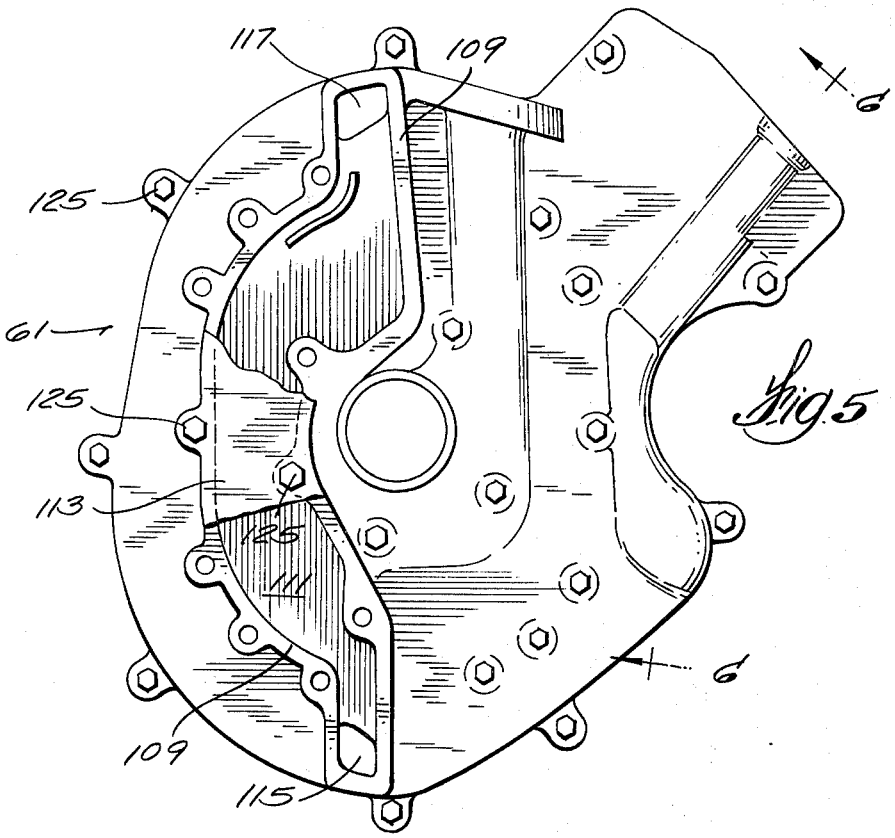
FIG. 5 is an outside view of the cover shown in FIG. 4, with parts broken away.

More specifically, the cover 61 includes a first portion 67 which further defines the rotor cavity 25, together with a second portion 69 which further defines the cooling jacket 37. In addition, the cover 61 includes (See FIG. 4) an endless recess 71 which extends circumferentially around the second portion 69 further defining the cooling jacket 37. Located in the endless recess 71 is a sealing member in the form on an O-ring 75 which sealingly engages the cover 61 and the opposed end wall 17 to prevent escape of coolant from the cooling jacket 37.

Still more specifically, the second portion 69 of the cover 61 defining the cooling jacket 37 can, if desired, (See FIG. 1) be recessed as indicated at 79 to increase the volume of the cooling jacket 37. Furthermore, placement of the endless recess 71 in the cover 61 permits formation of the first and second wall means 21 and 41 of the housing member 15 with thinner sections than would be possible if the O-ring 75 were contained in a recess in the end wall 17 of the housing member 15. In addition, the wall surface of the cover 61 adjacent to the endless recess 71 can extend along the inner face between the cover 61 and the end wall 17, as desired, to provide adequate side support for the O-ring 75 without affecting the width or thickness of the parts of the end wall 17 formed by the first and second wall means 21 and 41, respectively, of the housing member 15. Furthermore, use of the covers 61 and 63 to complete the cooling jacket 37 serves to provide direct heat removal from the covers 61 and 63.

Figure 6:
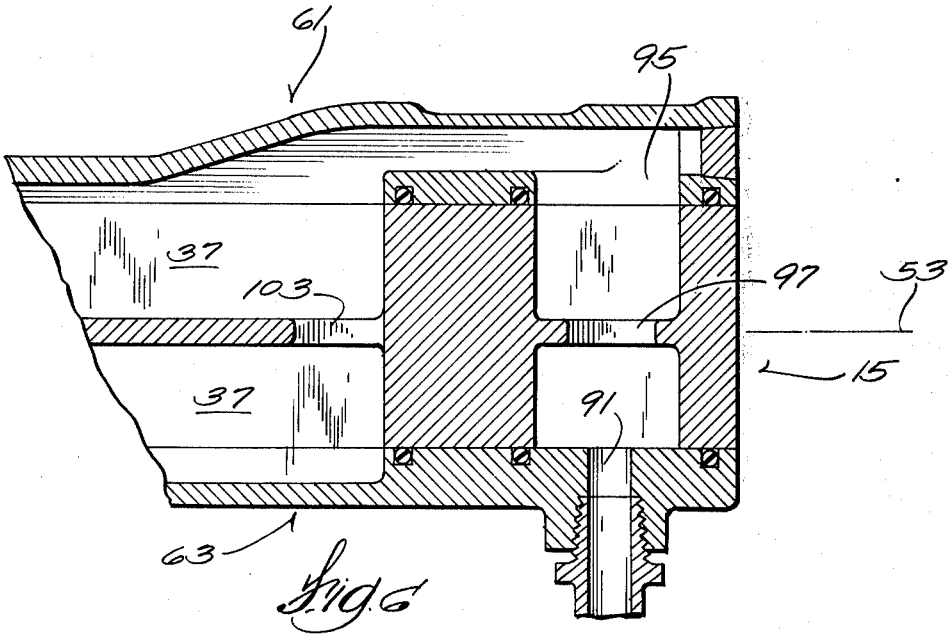
FIG. 6 is a fragmentary, enlarged sectional view taken along line 6—6 of FIG. 5.

The covers 61 and 63 differ with respect to one another in that the lower cover 63 includes both coolant inlet and outlet means (See FIGS. 2 and 6) in the form of inlet and outlet passages 91 and 93, respectively, and in that the upper cover 61 includes an outlet passageway or port 95 communicating with the cooling jacket 37 adjacent one end thereof and communicating through a port 97 extending in the housing member 15, with the outlet passage 93 in the lower cover 63.

Still more specifically, the inlet and outlet passages 91 and 93 in the lower cover are adapted to communicate respectively with suitable means for supplying coolant to the cooling jacket 37 and with suitable means for discharging coolant from the cooling jacket 37. In addition, the inlet passage 91 communicates with the partially circumferentially extending cooling jacket 37 adjacent to one end thereof, and the outlet passageway 95 in the cover 61 communicates with the cooling jacket 37 adjacent to the other end thereof so as to provide circumferential coolant flow along the housing member 15 and particularly along the cavity portion 31, as compared to axial coolant flow.

It is noted that the web 51 is apertured at 101 adjacent to the inlet passage 91 and at 103 adjacent to the outlet passageway 95 to afford circumferential flow along the housing member 15 on each side of the web 51. In addition, in the area of the spark plug 29, the web 51 is apertured at 105 (See FIG. 3) to provide increased surface area around the spark plug 29 so as thereby to obtain increased heat transfer.

If desired, increased heat removal from the covers 61 and 63 can be provided by forming additional cooling jackets extending along one or both of the covers adjacent to the rotor cavity portion 31 in which combustion takes place. In order to obtain balanced, optimum heat removal, such cover cooling jackets are preferably arranged in parallel relation to the portion of the cooling jacket 37 extending around the spark plug 29.

More specifically, the cover 61 (as well as the cover 63) can be constructed to include additional wall means 109 partially defining a cover cooling jacket 111, which cover cooling jacket 111 is further defined by a cover plate 113 connected to the cover 61 by suitable means, such as the bolts still to be described. Any suitable gasket or seal between the cover plate 113 and the cover 61 can be used.

Still further, the cover 61 includes an inlet port 115 which communicates through the cover 61 between a part of the circumferentially extending cooling jacket 37 on the inlet side of the spark plug 29 and the inlet end of the cover cooling jacket 111. In addition, the cover 61 includes an outlet port 117 extending through the cover 61 from the other or outlet end of the cover cooling jacket 111 to a part of the cooling jacket 37 extending circumferentially on the housing member 15 in the area thereof on the other or outlet side of the spark plug 29. Thus, flow in the cover cooling jacket 111 is parallel to the circumferential flow in the cooling jacket 37 past the spark plug 29.

The cover cooling jacket 111 and the cooling jacket 37 extending along the housing member 15 can be designed so as to balance the restrictions to flow therein in order to obtain optimum heat removal. Such restrictions can include such things as the size of the various passageways and ports, baffling, and other techniques well known in the art. In addition, in the area of the spark plug 29, the cooling jacket 37 narrows in cross section so as to afford increased coolant velocity and thereby to obtain increased heat removal.

Figure 1:
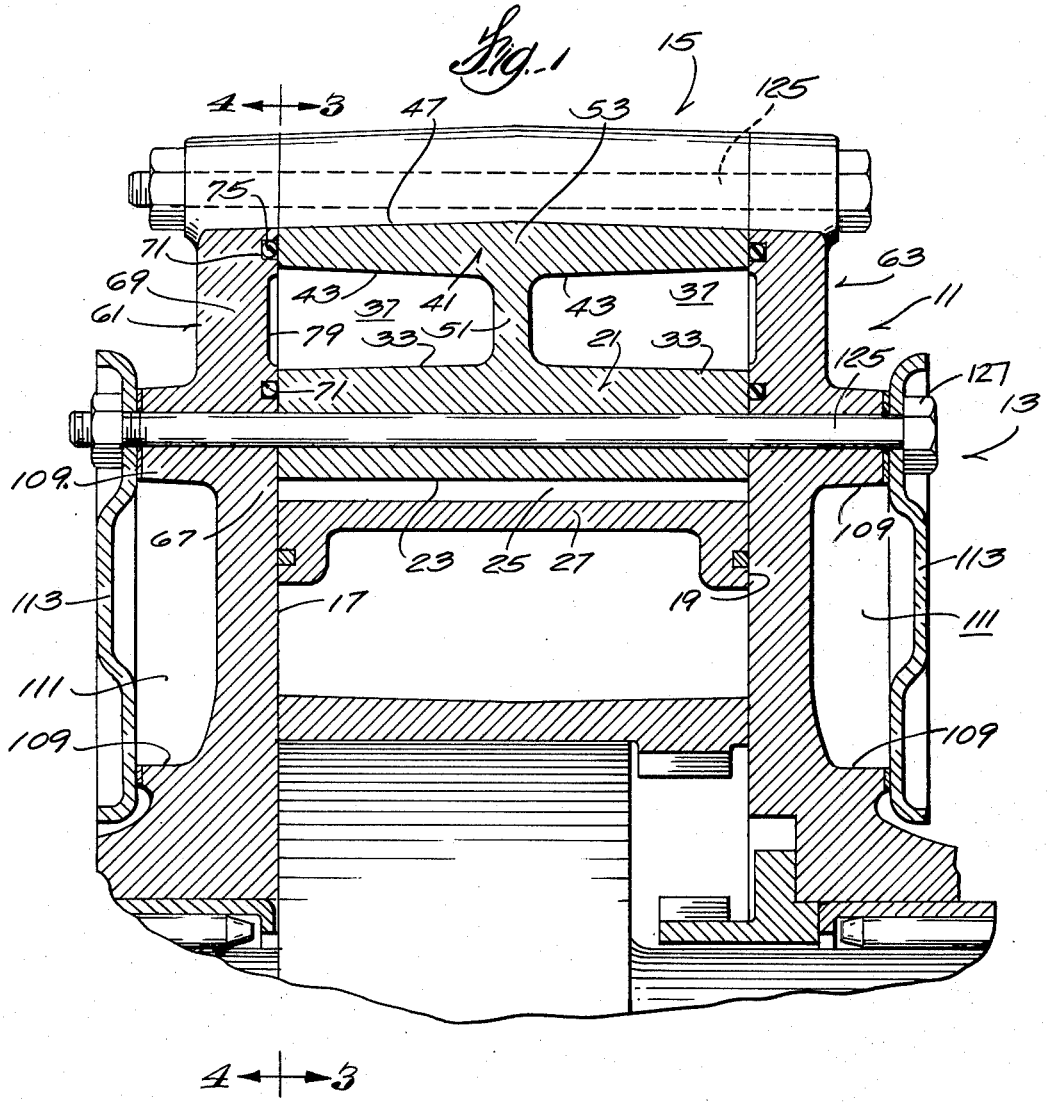
FIG. 1 is a fragmentary sectional view of a rotary internal combustion engine embodying various of the features of the invention.
Figure 2:
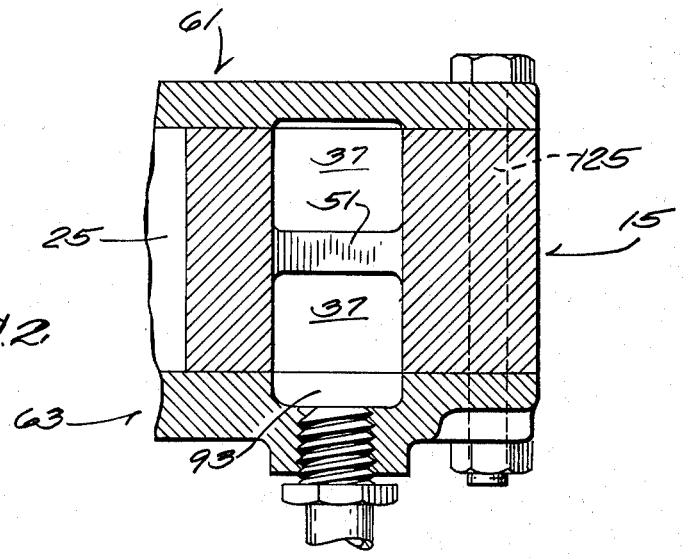
FIG. 2 is a fragmentary sectional view taken along line 2—2 of FIG. 3.

While other means could be provided, means in the form of through bolts are provided for assembling the covers 61 and 63 to the housing member 15 to form the housing assembly 13. In this regard, a plurality of headed bolts 125 pass through the cover 61, and through the housing member 15, and can be threaded into the cover 63 or can pass through the cover 61 and be threaded into respective nuts 127 located exterior to the cover 63 so as to retain the covers 61 and 63 in assembled relation to the housing member 15. The same bolts 125 can be employed to connect the cooling jacket cover plate or plates 113 to the cover or covers 61 and 63. In order to avoid individually sealing of the bolts 125, the bolts are each located outside of the areas bounded by the endless recesses 71 in the covers 61 and 63. Specifically, as shown in FIGS. 1 and 2, the bolts 125 can extend through holes or apertures in the first wall means 21, or in the second wall means 41, or in both the first and second wall means 21 and 41. Still more specifically, it will be seen that the bolts 125 can extend in the first wall means 21 between the rotor cavity 25 and the cooling jacket 37, and can also extend in the second wall means 41 outwardly of the cooling jacket 37.

Various of the features of the invetion are set forth in the following claims.

What is claimed is:

1. A rotary internal combustion engine comprising a unitary housing member including first annularly extending wall means including an outwardly facing surface partially defining a cooling jacket extending generally circumferentially around said first wall means and including ends spaced circumferentially of said cavity, and an inwardly facing surface partially defining a rotor cavity, said housing member also including second wall means extending in outwardly spaced relation from said first wall means and including an inwardly facing surface in opposing relation to said outwardly facing surface of said first wall means to further partially define said cooling jacket, said housing member also including web means extending generally transversely to and joining said first and second wall means, said housing also including opposite end walls to which said first and second wall means extend and further including first and second covers located respectively on said opposite end walls to provide a housing assembly and respectively including first portions further defining said rotor cavity and second portions further defining said cooling jacket, and (wherein) said housing assembly also including (includes) coolant inlet means located in one of said covers adjacent to one circumferential end of said cooling jacket and coolant outlet means located in the other of said covers adjacent to the other circumferential end of said cooling jacket, said coolant inlet means and coolant outlet means communicating with the cooling jacket to provide circumferential coolant flow in said cooling jacket.

2. A rotary internal combustion engine comprising a housing assembly including a housing member having opposite end walls and wall means partially defining a rotor cavity extending between said end walls and having a portion in which combustion takes place and also partially defining a first coolant jacket extending circumferentially of said housing member adjacent to said cavity portion and between said end walls, said housing assembly also including a first cover on one of said end walls of said housing member and including wall means further defining said rotor cavity and also further defining said first coolant jacket, said first cover also including other wall means spaced from said rotor cavity for partially defining a second coolant jacket extending along said first cover adjacent to said cavity portion, said housing asembly also including a second cover on the other of said end walls of said housing member and including wall means further defining said rotor cavity and also further defining said first coolant jacket, said second cover also including other means spaced from said rotary cavity for partially defining a third coolant jacket extending along said second cover adjacent to said cavity portion, said housing assembly also including coolant inlet means located in one of said covers and communicating with each of said first, second, and third coolant jackets and coolant outlet means located in the other of said covers and communicating with each of said first, second, and third coolant jackets, whereby one portion of the coolant flows between said inlet means and said outlet means through said first coolant jacket and another portion of the coolant flows between said inlet means and said outlet means through said second coolant jacket, and still another portion of the coolant flows between said inlet means and said outlet means through said third coolant jacket.

3. A rotary internal combustion engine comprising a housing assembly including a housing member having an end wall and wall means partially defining a rotor cavity extending to said end wall and having a portion in which combustion takes place and also partially defining a cooling jacket extending adjacent to the cavity portion and to said end wall, said housing assembly also including a cover on said housing member end wall and including a first portion further defining said rotor cavity, and a second portion further defining said cooling jacket, one of said cover and said end wall including an endless recess extending circumferentially around said cooling jacket, said housing assembly also including means extending between said housing member and said cover outside of the area bounded by said endless recess for connecting said cover to said end wall, and a sealing member located in said endless recess and in sealing engagement with said cover and with said end wall to prevent loss of coolant from said cooling jacket between said cover and said housing member.

4. A rotary internal combustion engine in accordance with claim 3 wherein said housing member is unitarily constructed and includes first annularly extending wall means including an outwardly facing surface partially defining said cooling jacket and an inwardly facing surface partially defining said rotor cavity, said housing member also including second wall means extending in outwardly spaced relation from said first wall means and including an inwardly facing surface in opposing relation to said outwardly facing surface of said first wall means to further partially define said cooling jacket, said housing member also including web means extending generally transversely to and joining said first and second wall means.

5. A rotary internal combustion engine including a housing assembly including a housing member including an end wall, said housing member also including wall means partially defining a rotor cavity extending to said end wall, said housing member also including means partially defining a cooling jacket extending to said end wall and in adjacently spaced relation from the rotor cavity, a cover on said end wall and including a first portion further defining said rotor cavity, said cover also including a second portion further defining said cooling jacket, said cover also including an endless recess extending circumferentially around said second portion further defining said cooling jacket, means extending between said housing member and said cover outside of the area bounded by said endless recess for connecting said cover to said end wall, and a sealing member located in said endless recess and in sealing engagement with said cover and with said end wall to prevent loss of coolant from said cooling jacket between said cover and said housing member.

6. A rotary internal combustion engine in accordance with claim 5 wherein said connecting means extends in the area between the rotor cavity and said recess.

7. A rotary internal combustion engine in accordance with claim 5 wherein said connecting means extends in the area located outwardly of said recess and remotely from the rotor cavity.

8. A rotary internal combustion engine in accordance with claim 5 wherein said housing member is unitarily constructed and includes first annularly extending wall means including an outwardly facing surface partially defining said cooling jacket and an inwardly facing surface partially defining said rotor cavity, said housing member also including second wall means extending in outwardly spaced relation from said first wall means and including an inwardly facing surface in opposing relation to said outwardly facing surface of said first wall means to further partially define said cooling jacket, said housing member also including web means extending generally transversely to and joining said first and second wall means.

9. A rotary internal combustion engine in accordance with claim 5 wherein said connecting means comprises bolts extending in said cover and said housing member.

10. A rotary internal combustion engine in accordance with claim 5 wherein said housing member further includes a second end wall spaced from said first mentioned end wall and wherein said housing assembly further includes a second cover on said second end wall of said housing member and including a first portion further defining said rotor cavity, said second cover also including a second portion further defining said cooling jacket, said second cover also including an endless recess extending circumferentially around said second portion of said second cover further defining said cooling jacket, wherein said means connecting said first cover to said housing member also connects said second cover to said housing member outside of the area bounded by said endless recess in said second cover, and a sealing member located in said endless recess in said second cover and in sealing engagement with said second cover and with said second end wall to prevent loss of coolant from said cooling jacket between said second cover and said housing member.

* * * * *

PO-1050
(5/69)

UNITED STATES PATENT OFFICE
CERTIFICATE OF CORRECTION

Patent No. 3,975,122 Dated August 17, 1976

Inventor(s) Eugene R. Hackbarth and Harry M. Ward III

It is certified that error appears in the above-identified patent and that said Letters Patent are hereby corrected as shown below:

| | |
|---|---|
| Column 1, line 6 | delete "engine", insert ---engines---. |
| Column 3, line 7 | delete "he", insert ---the--- |
| Column 6, line 5 | delete "(wherein)" |
| Column 6, line 6 | delete "(includes)" |

Signed and Sealed this

Eleventh Day of January 1977

[SEAL]

*Attest:*

RUTH C. MASON
*Attesting Officer*

C. MARSHALL DANN
*Commissioner of Patents and Trademarks*